US006316709B1

(12) United States Patent
Nanberg et al.

(10) Patent No.: US 6,316,709 B1
(45) Date of Patent: Nov. 13, 2001

(54) ADAPTABLE PERCUSSION ACCESSORY FOR A PERCUSSION TOOL

(75) Inventors: Steven Nanberg, Highland Park; Graziano P. Perrelli, Chicago, both of IL (US)

(73) Assignee: Pernan Global, Inc., Highland Park, IL (US)

( * ) Notice: Subject to any disclaimer, the term of this patent is extended or adjusted under 35 U.S.C. 154(b) by 0 days.

(21) Appl. No.: 09/645,263

(22) Filed: Aug. 24, 2000

(51) Int. Cl.[7] ..... G10D 13/02

(52) U.S. Cl. ..... 84/422.4; 84/402; 84/418; 84/420; D17/22

(58) Field of Search ..... 84/422.4, 422.1, 84/402, 418, 420; D17/22

(56) References Cited

U.S. PATENT DOCUMENTS

| | | | | |
|---|---|---|---|---|
| D. 211,964 | * | 8/1968 | Valente | D17/22 |
| D. 220,002 | * | 2/1971 | Barker | D17/22 |
| 2,466,554 | * | 4/1949 | Mossey | 84/422.4 |
| 3,592,097 | * | 7/1971 | Friede | 84/402 |
| 4,216,696 | * | 8/1980 | Alexis, Jr. | 84/422.3 |
| 4,244,267 | * | 1/1981 | Nemeth | 84/418 |
| 4,269,105 | * | 5/1981 | Salmon | 84/402 |
| 4,426,906 | * | 1/1984 | Otto | 84/402 |
| 4,776,254 | * | 10/1988 | Cruz | 84/422.1 |
| 5,272,951 | * | 12/1993 | Cohen | 84/402 |
| 5,367,939 | | 11/1994 | Barker . | |
| 6,096,957 | * | 8/2000 | Anderson | 84/422.1 |

OTHER PUBLICATIONS

Concert Tamborines Website: http.//www.blackswamp.com/bsp/framespages/tambosfr.htm.

Projection–Plus™ Tambourines Website: http.//www.groverpro.com/protext.htm.

Professional Concert Castanets Website: http://www.blackswamp.com/bsp/frames pages/castanetsfr.htm.

Percussion Website: http://www.larkinam.com/MenComNet/Business/Retail/Larknet/Percussion.

* cited by examiner

*Primary Examiner*—Shih-Yung Hsieh
(74) *Attorney, Agent, or Firm*—Wallenstein & Wagner, Ltd.

(57) ABSTRACT

The present invention is a percussion accessory for attachment to a percussion tool, such as a drum stick. The percussion tool has an attachment region, and the percussion accessory is provided for creating musical sounds through the use of percussion tool by a user. The percussion accessory has a attachment means for attaching the percussion accessory to the attachment area of the percussion tool; a support attached to and extending from the attachment means; and, a sound device, such as a jingle, moveably attached to the support, wherein the sound device will move to create the musical sounds when the user uses the percussion tool. The percussion accessory also has a muffle device. The muffle device has a muffle and a lever. A muffling material is attached to the top of the muffle for engaging the sound device. The muffle device is pivotally attached to the support, wherein when the user presses the lever, the muffling material will engage the sound device for muffling the sound device.

22 Claims, 4 Drawing Sheets

ADAPTABLE PERCUSSION ACCESSORY FOR A PERCUSSION TOOL

DESCRIPTION

1. Technical Field

The present invention generally relates to percussion accessory instruments. More particularly, the present invention relates to a device adaptable for attachment to a percussion tool, scu as a drum stick, for creating percussion accessory sounds.

2. Background of the Invention

Presently, there are numerous percussion accessories and accessory instruments, such as tambourines, cow bells, maracas, triangles, and other which are used to add flavor to the rest of the percussion sounds and music within a musical work, such as a sound recording. Typically, these types of percussion accessories are held in a user's hand and are shaken, struck with the user's other hand, struck with a drum stick or other percussion tool, struck into the user's leg, or a combination of the two or more of the above. However, when a user must use his or her hand or hands to play the percussion tool, those hands are no longer available to play other percussion instruments, percussion accessories, hold other percussion tools, or play other instruments generally, such as a keyboard.

One prior percussion accessory is set of jingle bells that are attached to a strap which can be worn around a users hand. This type of percussion accessory uses up one of the users hands, and prevents the user from using this hand for other percussion accessories or tools, or other instruments.

Another prior percussion accessory is disclosed in U.S. Pat. No. 5,367,939, to Barker, entitled "Hand Held Cymbal Device." The Barker patent is directed to a cymbal device for use with one hand, including a shaft extending along an axis and two cymbals coaxially mounted on the shaft so that one of the cymbals is moveable relative to the other. The Barker patent further discloses a trigger mechanism coupled to the shaft for displacing the moveable cymbal relative to the other cymbal to bring the cymbals inito engagement with one another. The Barker patent also discloses that a handle is secured to the shaft at a position enabling a user to grasp the handle and actuate the trigger mechanism with one hand. This device allows for the cymbals to be played with one hand while having the cymbal device mobile, instead of the cymbals being on a well known stationary "hi-hat" stand. However, this ends up taking away the use of at least one hand, which hand would otherwise be available if a stationary "hi-hat" was used.

The present invention is directed to solving these and other problems.

SUMMARY OF THE INVENTION

The present invention is a percussion accessory for attachment to a percussion tool having an attachment region. The percussion accessory is provided for creating musical sounds through the use of percussion tool by a user. The percussion accessory has an attachment means for attaching the percussion accessory to the attachment region of the percussion tool; a support attached to and extending from the attachment means; and, a sound device moveably attached to the support, wherein the sound device will move to create the musical sounds when the user uses the percussion tool.

The attachment means can have a first fastener and a second fastener. The first fastener can be attached to the support toward a first end of the support, and the second fastener can be attached to the support toward a second end of the support.

The sound device can take the form of a jingle, string beads, or some other musical device. In one form of the present invention, the sound device has a first disk jingle generally within in a first plane, the first disk jingle having a first central bore; and, a second disk jingle generally within a second plane, the second disk jingle having a second central bore. The percussion accessory also has an attachment pin. The fist and second planes of the first and second disk jingles can be generally parallel and the pin can be attached to the support and extend through the first and second central bores of the first and second disk jingles generally aligning the first and second bores. The first and second disk jingles contact one another to create the musical sounds when the user uses the percussion tool.

The support can have a first support arm extending generally below the sound device; and, a second support arm extending generally above the sound device. The pin can extend from the first support arm to the second support arm, and the first and second jingle disks can be located between the first and second support arms. Multiple sound devices in this arrangement can be used within the percussion accessory, and are moveably attached to the support. Multiple rows of sound devices can be used within the percussion accessory as well.

The percussion accessory can also has a muffle device. The muffle device has a muffle with a top, and a lever. The muffle device can be pivotally attached to the support for muffling the sound device when the user presses on the lever. The muffle device can also have a muffling material attached to the top of the muffle for engaging the sound device. When the user presses the lever, the muffle, and more particularly, the muffling material, will engage the sound device for muffling the sound device.

In another embodiment of the present invention, the present invention is a jingle accessory for attachment to a percussion tool having an attachment region. The jingle accessory is provided for creating musical sounds through the use of percussion tool by a user. The jingle accessory has a fastener for attaching the jingle accessory to the attachment region of the percussion tool; a support attached to and extending from the fastener; and, a jingle moveably attached to the support. The jingle moves to create the musical sounds when the user uses the percussion tool. Other features can be provided as mentioned above.

In a further embodiment of the present invention, the present invention is a jingle accessory for attachment to a drum stick having an attachment region. The jingle accessory is provided for creating musical sounds through the use of the drum stick by a user. The jingle accessory has a fastener for attaching the jingle accessory to the attachment region of the drum stick; a support attached to and extending from the fastener; and, a jingle moveably attached to the support. The jingle moves to create the musical sounds when the user uses the drum stick.

The present invention will be more fully described in the following detailed description with reference being made to the drawings and the claims appended thereto.

DETAILED DESCRIPTION

Figure 1:
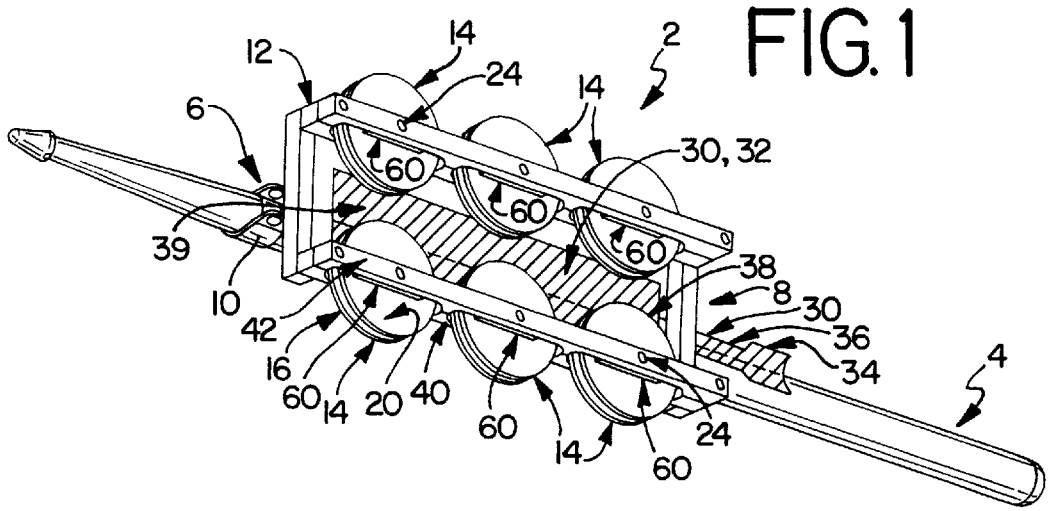
FIG. 1 is a perspective view of one embodiment of a percussion accessory of the prevent invention attached to one type of percussion tool.
Figure 2:
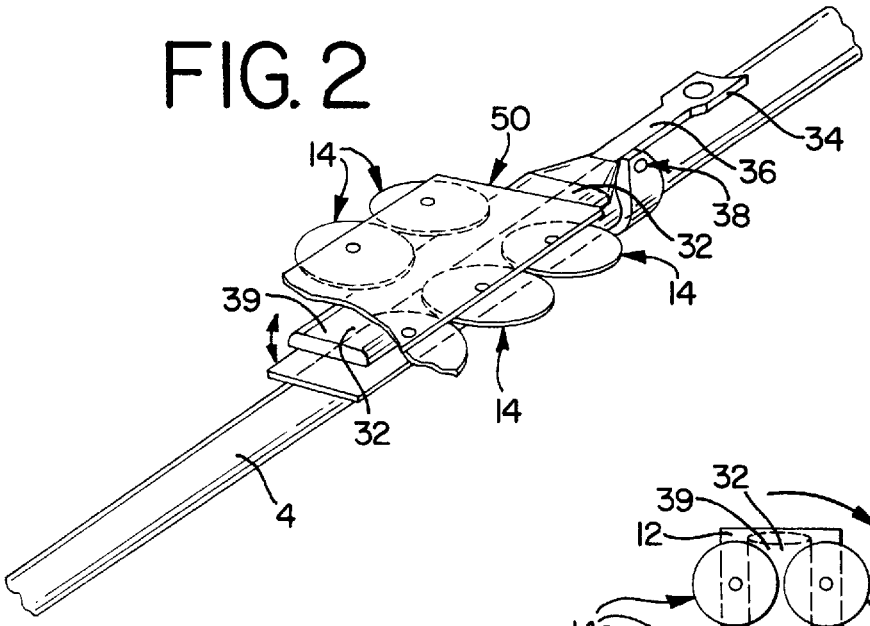
FIG. 2 is fragmented perspective view another embodiment of a percussion accessory of the present invention attached to a cut away of one type of percussion tool.
Figure 3:
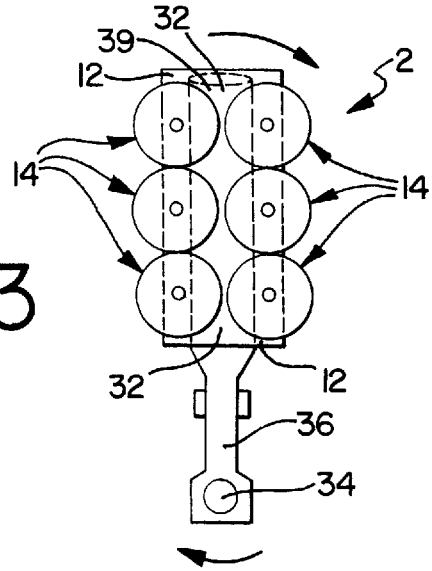
FIG. 3 is top view of the embodiment of the percussion accessory of the present invention of FIG. 1.
Figure 4:
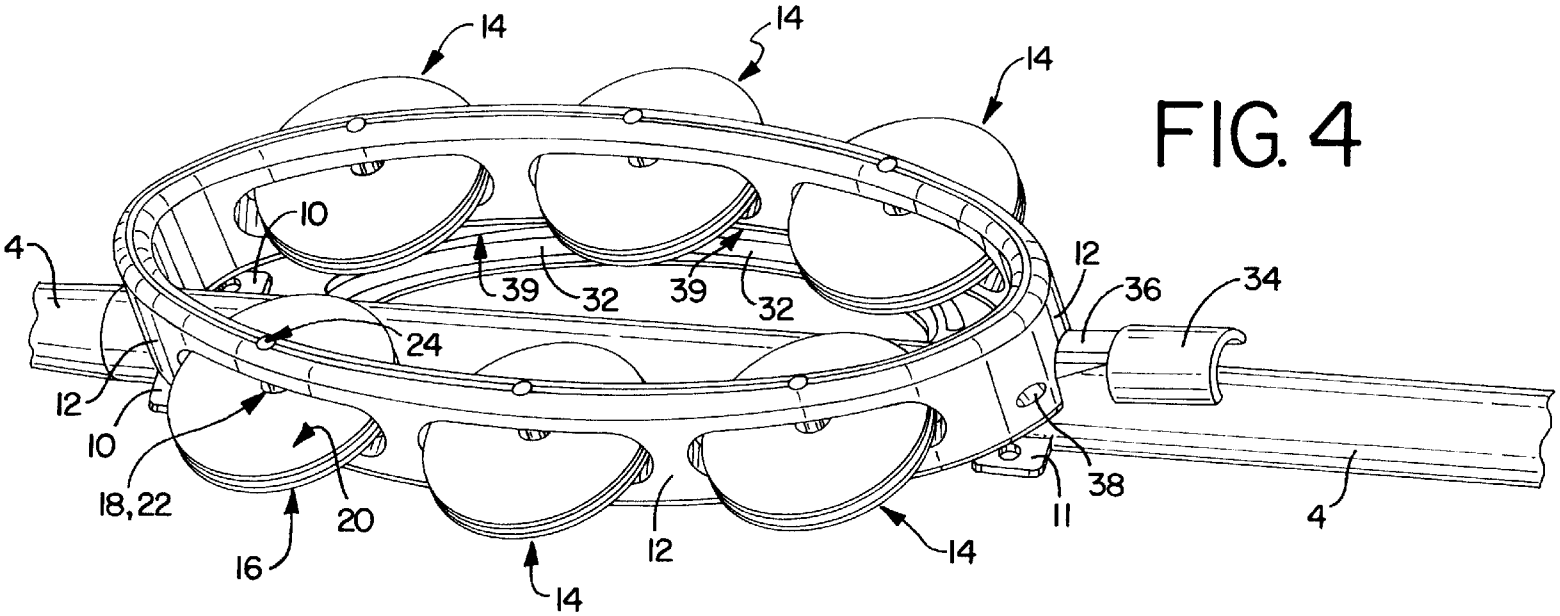
FIG. 4 is a perspective view of another embodiment of a percussion accessory of the present invention attached to cut away of one type of percussion tool.
Figure 5:
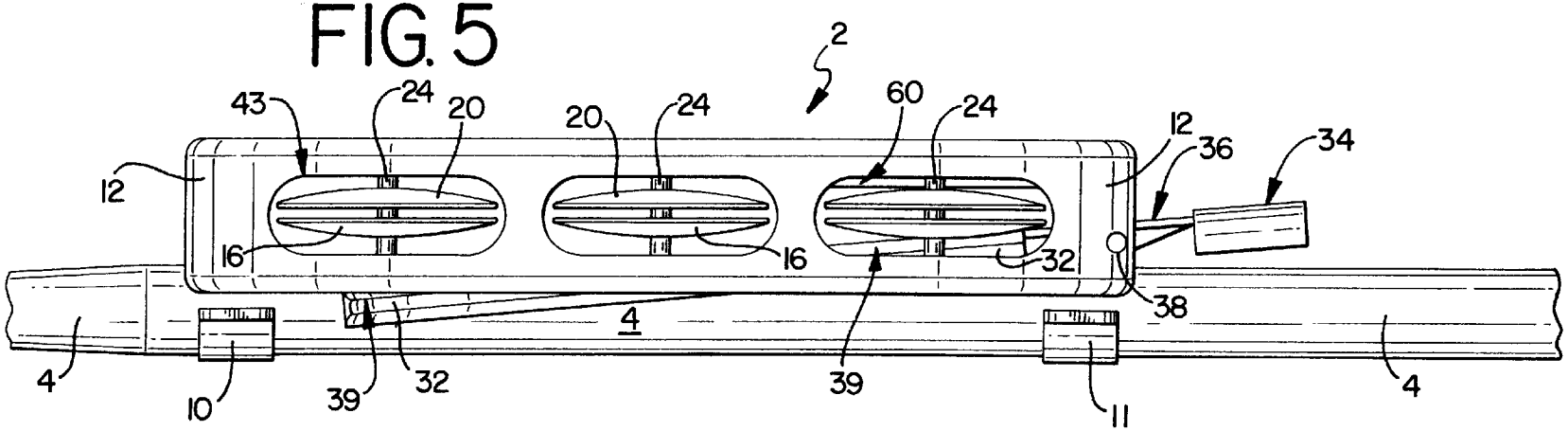
FIG. 5 is a side view of the embodiment of the percussion accessory of the present invention of FIG. 4.
Figure 6:
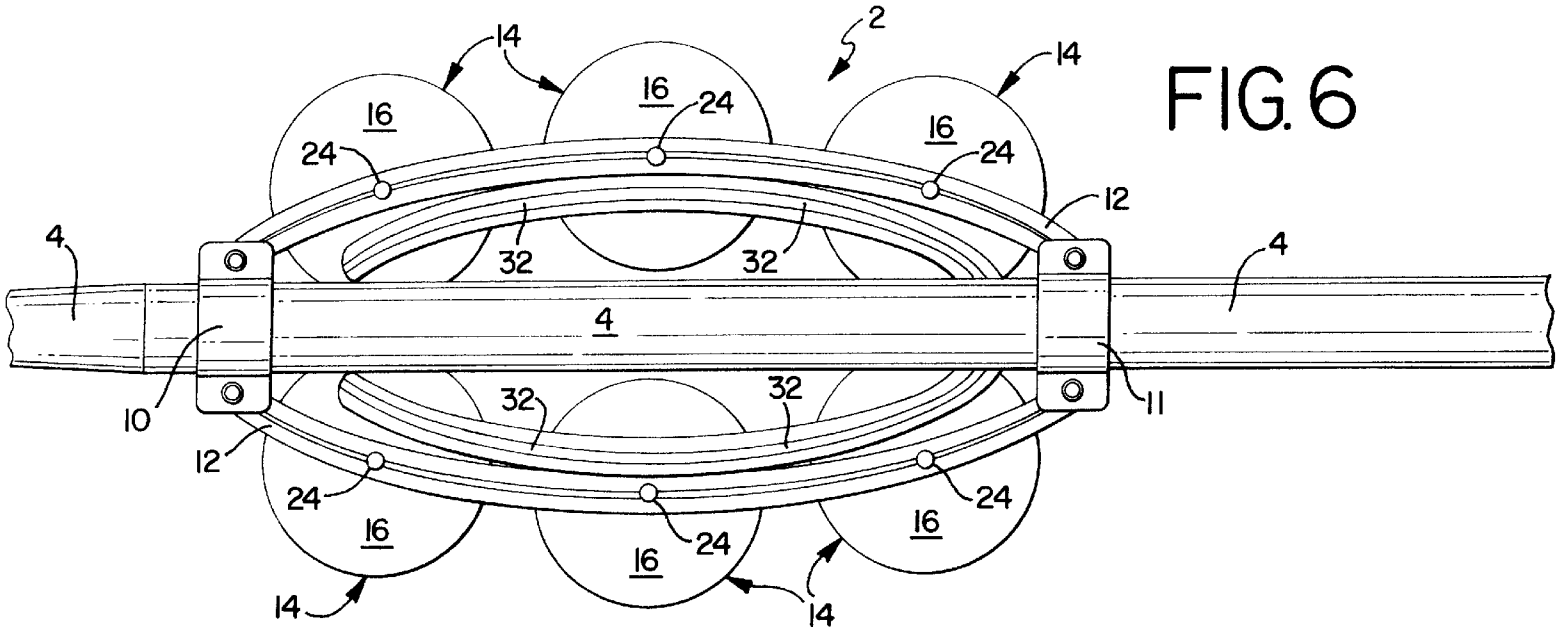
FIG. 6 is a bottom view of the embodiment of the percussion accessory of the present invention of FIG .4.
Figure 7:
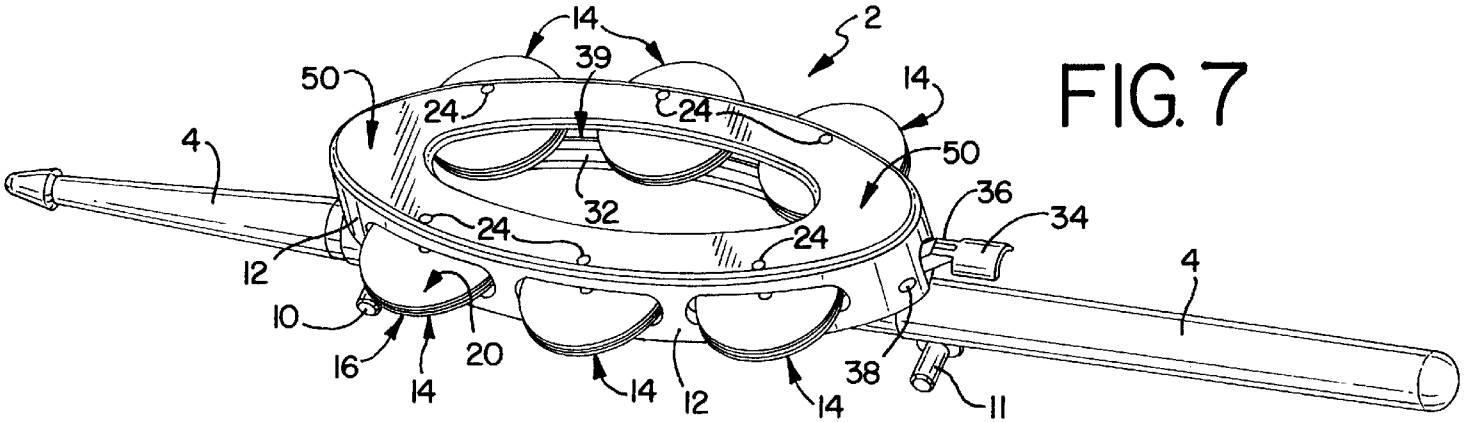
FIG. 7 is a perspective view of another embodiment of a percussion accessory of the present invention attached to cut away of one type of percussion tool.
Figure 8:
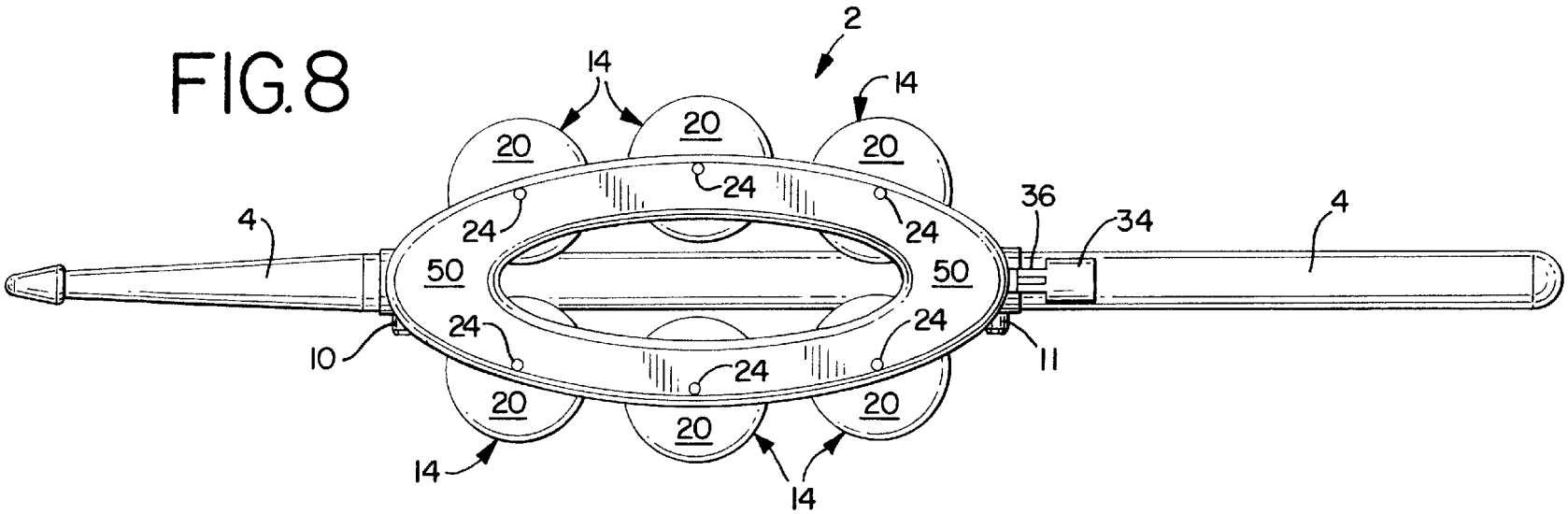
FIG. 8 is a top view of the embodiment of the percussion accessory of the present invention of FIG. 7.
Figure 9:
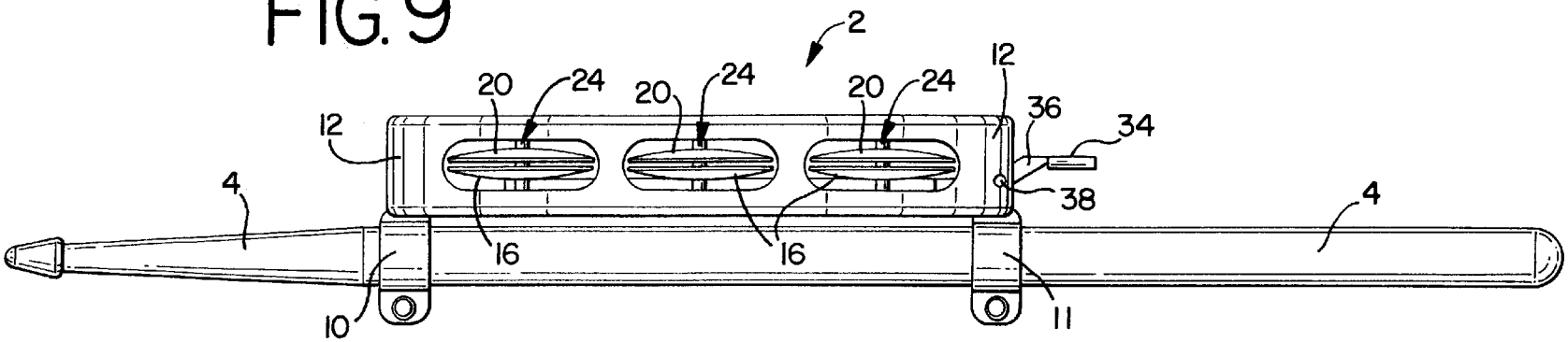
FIG. 9 is a side view of the embodiment of the percussion accessory of the present invention of FIG. 7.

With reference to FIGS. 1 and 3, one embodiment of the present invention is shown. In particular, a percussion accessory 2 is provided for attachment to a percussion tool 4 having attachment regions 6, 8. The percussion accessory 2 is provided for creating musical sounds through the use of the percussion tool 2 by a user. In the particular form of the invention shown in FIGS. 1 and 3, the percussion accessory 2 is a jingle accessory 2 for attachment to a drum stick 4. Another embodiment of the present invention is shown in FIGS. 3, 4, and 5. A further embodiment of the present invention is shown in FIGS. 6, 7, and 8. The embodiment shown in FIG. 2 and the embodiment shown in FIGS. 6, 7, and 8 also include a housing or cover 50, as discussed below. The jingle accessory 2 makes musical sounds similar to a tambourine. The jingle accessory 2 has a fastener 10 for attaching the jingle accessory 2 to the attachment region 6 of the drum stick 4. A support 12 is attached to and extending from the fasteners 6, 8. A sound device 14 is moveably attached to the support 12. The sound device 14 moves to create the musical sounds when the user uses the drum stick 4. It has been found that when the user uses the drum stick to play, for instance, a ride cymbal, the jingle accessory makes musical sounds that are in close to perfect syncopation with the cymbal playing.

Two fasteners 10, 11 may be needed to attach the jingle accessory to the drum stick. The first fastener 10 can be attached to the support 12 toward a first end of the support 12, and the second fastener 11 can be attached to the support 12 toward a second end of the support 12. Each fastener 10, 11 can be adjustable to accept different sized percussion tools 4, such as different sized (thickness) drum sticks 4. Thus, the jingle accessory can be used with conventional drum sticks 4 and other percussion tools 4. The fasteners 10, 11 can take the form of a clamp 10, 11 or some other form of fastening or attachment device.

As shown in all of the FIGS, the sound device 14 can take the form of a jingle 14, string beads (not shown), or some other musical device capable of making musical sounds. In one form of the present invention, the sound device has a first disk jingle 16 generally within in a first plane, the first disk jingle 16 having a first central bore 18; and, a second disk jingle 20 generally within a second plane, the second disk jingle 20 having a second central bore 22.

The jingle accessory 2 also has an attachment pin 24. The fist and second planes of the first and second disk jingles 16, 20 can be generally parallel and the pin 24 can be attached to the support and extend through the first and second central bores 18, 22 of the first and second disk jingles 16, 20 generally aligning the first and second bores 18, 22, as shown. The first and second disk jingles 16, 20 contact one another to create the musical sounds when the user uses the drum stick 4.

The support 12 can have a first support arm 40 extending generally below the sound device 14; and, a second support arm 42 extending generally above the sound device 14. The pin 24 can extend from the first support arm 40 to the second support arm 42, and the first and second jingle disks 16, 20 can be located between the first and second support arms 40,42. The vertical spacing 43, as generally shown in FIG. 5, between the first and second support arms is preferably about ⅜ to ½ inches, and more particularly, about 5⁄16 to 10⁄16 inches. This vertical spacing 43 may be important to achieving proper musical syncopation during use. The size of the jingles will determine the appropriate vertical spacing 43, as one of ordinary skill would understand. As shown, multiple sound devices 14, similar to a tambourine, can be used within the jingle accessory 2, and are moveably attached to the support 12. Also as shown, multiple rows of sound devices 14 can be used within the jingle accessory 2 can be used as well.

The jingle accessory 2 can also has a muffle device 30. The muffle device 30 is used to muffle or mute the sound device(s) 14. The muffle device 30 has a muffle 32 with a top side thereof. The muffle device 30 also has a lever 34 attached to a bar 36, which in turn is attached to the muffle 32. The muffle device 30 can be pivotally attached to the support 12 for muffling the sound device 14 when the user presses on the lever 34. A pivot 38, around which the muffle device 30 pivots, can be moveably attached to the support 12. The muffle device can be biased, through a spring or other biasing mechanism, for keeping the jingles 14 muffled, or biased in the other direction for allowing the jingles 14 to make musical sounds. The user would need to press against the lever 34 in the opposite direction to the biasing direction in order to actuate the muffle device 30 and achieve the respective appropriate result (non-muffling or muffling, depending on the bias direction). The muffle device 30 can also have a muffling material 39, such as rubber, attached to the top of the muffle 32 for engaging the sound device(s) 14. When the user presses the lever 34, the muffle 32, and more particularly, the muffling material, will engage the sound device(s) 14 for muffling the sound device(s) 14. As shown in FIGS. 1 and 5, the jingle accessory 2 can also have a upper muffle material 60 located and attached underneath the second support arm 42, and located above the second disk jingle 20. When the muffle device 30 is pressed against the sound device(s) 14, the upper or second disk jingle 20 is pressed against the upper muffle material, for enhancing the muffling or muting of the sound device(s) 12. It should be appreciated that the upper muffle material 60 can be placed within the jingle accessory 2 in relation to, and/or above, all of the sound devices 14 for enhanced muffling or muting of all of the sound device(s) 14.

The jingle accessory 2 can also have a housing or cover 50, for example made of plastic, as shown in FIGS. 2, 6, 7, and 8. The housing or cover 50 can be provided for protection of the rest of the jingle accessory 2, for aesthetic purposes, or both. Many of the other elements of the present invention can be made of durable plastic or light-weight metal, so as to end up with a durable, yet light-weight jingle accessory 2.

It should be appreciated that the jingle accessory 2 allows a user to add a "tambourine effect" within the user's drumming. Thus, no third hand is needed to perform the "tambourine effect" while the user is drumming.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to a particular embodiment disclosed as the best mode contemplated for carrying out the invention, but that the invention will include all embodiments falling within the scope of the appended claims.

We claim:

1. A percussion accessory for attachment to a percussion tool having an attachment region, the percussion accessory provided for creating musical sounds through the use of percussion tool by a user, the percussion accessory comprising:

a first fastener and a second fastener for attaching the percussion accessory to the percussion tool;

a support attached to and extending from the first and second fasteners; and, a sound device moveably attached to the support, wherein the sound device will move to create the musical sounds when the user uses the percussion tool.

2. The percussion accessory of claim 1 wherein the first and second fasteners are adjustable to accept different sized percussion tools.

3. The percussion accessory of claim 1 wherein the sound device is a jingle.

4. The percussion accessory of claim 1 wherein the sound device comprises:

a first disk jingle generally within in a first plane, the first disk jingle having a first central bore; and, a second disk jingle generally within a second plane, the second disk jingle having a second central bore; the percussion accessory further comprising:

an attachment pin, wherein the first and second planes of the first and second disk jingles are generally parallel, wherein the pin is attached to the support and extends through the first and second central bores of the first and second disk jingles generally aligning the first and second bores, and wherein the first and second disk jingles contact one another to create the musical sounds when the user uses the percussion tool.

5. The percussion accessory of claim 1 wherein the support comprises:

a first support arm extending generally below the sound device; and, a second support arm extending generally above the sound device, wherein an attachment pin extends from the first support arm to the second support arm; and wherein the sound device is located between the first and second support arms.

6. The percussion accessory of claim 1 further comprising: a plurality of sound devices moveably attached to the support.

7. The percussion accessory of claim 6 wherein each of the plurality of sound devices comprise a pair of jingle disks.

8. A percussion accessory for attachment to a percussion tool having an attachment region, the percussion accessory provided for creating musical sounds through the use of percussion tool by a user, the percussion accessory comprising:

attachment means for attaching the percussion accessory to the attachment region of the percussion tool;

a support attached to and extending from the attachment means;

a sound device moveably attached to the support, wherein the sound device will move to create the musical sounds when the user uses the percussion tool; and, a muffle device having a muffle having a top, the muffle device also having a lever, the muffle device being pivotally attached to the support for muffling the sound device when the user presses on the lever.

9. The percussion accessory of claim 8 wherein the muffle device further comprises:

a muffling material attached to the top of the muffle for engaging the sound device, wherein the user pressing the lever will cause the muffling material to engage the sound device for muffling the sound device.

10. A jingle accessory for attachment to a percussion tool having an attachment region, the jingle accessory provided for creating musical sounds through the use of percussion tool by a user, the jingle accessory comprising:

a fastener for attaching the jingle accessory to the attachment region of the percussion tool;

a support attached to and extending from the fastener, wherein the support includes a first support arm extending generally below a plurality of jingles, and a second support arm extending generally above the plurality of jingles, the first support arm for extending along a length of the percussion tool, the first support arm having a first plane extending therethrough, the second support arm for extending along the length of the percussion tool, the second support arm having a second plane extending therethrough, the first and second planes being generally parallel to one another and generally parallel to a third plane extending through the length of the percussion tool;

a plurality of attachment pins extending from the first support arm to the second support arm; and, a plurality of jingles moveably attached to the support with the pins extending from the first support arm to the second support arm, wherein the plurality jingles moves to create the musical sounds when the user uses the percussion tool.

11. The jingle accessory of claim 10 wherein the each jingle comprises:

a first disk jingle generally within a first plane, the first disk jingle having a first central bore; and, a second disk jingle generally within a second plane, the second disk jingle having a second central bore.

12. The jingle accessory of claim 11 wherein the planes of the first and second disk jingles are generally parallel, wherein the attachment pin extends through the first and second central bores of the first and second disk jingles generally aligning the first and second bores, and wherein the first and second disk jingles contact one another to create the musical sounds when the user uses the percussion tool.

13. The jingle accessory of claim 12 wherein the fastener comprises:

a first fastener; and, a second fastener, wherein the first fastener is attached to the support toward a first end of the support, wherein the second fastener is attached to the support toward a second end of the support.

14. The jingle accessory of claim 10 wherein the fastener is a clamp.

15. A jingle accessory for attachment to a drum stick having an attachment region, the jingle accessory provided for creating musical sounds through the use of the drum stick by a user, the jingle accessory comprising:

a fastener for attaching the jingle accessory to the attachment region of the drum stick;

a support attached to and extending from the fastener;

a jingle moveably attached to the support, the jingle including a first disk jingle and a second disk jingle, wherein the use of the drum stick will cause the first disk jingle to contact the second disk jingle to create the musical sounds; and, a muffle device having a muffle having a top, the muffle device also having a lever, the muffle device being pivotally attached to the support for muffling the first and second disk jingles when the user presses on the lever.

16. The percussion accessory of claim 15 wherein the muffle device further comprises:

a sound muffling material attached to the top of the muffle for engaging the first disk jingle, wherein the user pressing the lever will cause the sound muffling material to engage the first and second disk jingles into the support for muffling the first and second disk jingles.

17. A percussion accessory for creating musical sounds through the use of the percussion accessory by a user, the percussion accessory comprising:

an attachment means;

a support attached to and extending from the attachment means, wherein the support includes a first support arm extending generally below a plurality of sound devices, and a second support arm extending generally above the plurality of sound devices, the first support arm extending along a length, the first support arm having a first plane extending therethrough, the second support arm for extending along the length, the second support arm having a second plane extending therethrough, the first and second planes being generally parallel to one another;

a plurality of sound devices, each sound device including a first disk jingle generally within in a third plane, each first disk jingle having a first central bore, and a second disk jingle generally within a third plane, each second disk jingle having a second central bore, moveably attached to the support, wherein the sound devices will move to create the musical sounds when the user uses the percussion accessory, wherein the first and second planes are generally parallel to the third and fourth planes; and, a sound device mute moveably attached to the support, and engagable with all of the sound devices for muting the sound devices.

18. The percussion accessory of claim 17 wherein the attachment means is adjustable to accept different sized percussion tools.

19. The percussion accessory of claim 17 further comprising:

an attachment pin, wherein the second and third planes of the first and second disk jingles are generally parallel, wherein the pin is attached to the support and extends through the first and second central bores of the first and second disk jingles generally aligning the first and second bores, and wherein the first and second disk jingles contact one another to create the musical sounds when the user uses the percussion accessory.

20. The percussion accessory of claim 19 wherein the attachment means comprises:

a first fastener; and, a second fastener, wherein the first fastener is attached to the support toward a first end of the support, wherein the second fastener is attached to the support toward a second end of the support.

21. The percussion accessory of claim 17 wherein the sound device mute is a muffle device, the muffle device having a top, the muffle device also having a lever, the muffle device being pivotally attached to the support for muffling the sound device when the user presses on the lever.

22. The percussion accessory of claim 21 wherein the muffle device further comprises:

a muffling material attached to the top of the muffle for engaging the sound device, wherein the user pressing the lever will cause the muffling material to engage the sound device for muffling the sound device.

* * * * *

UNITED STATES PATENT AND TRADEMARK OFFICE

CERTIFICATE OF CORRECTION

PATENT NO. : 6,316,709 B1
DATED : November 13, 2001
INVENTOR(S) : Steven Nanberg and Graziano P. Perrelli It is certified that error appears in the above-identified patent and that said Letters Patent is hereby corrected as shown below:

Column 1,
Line 10, replace "scu" with -- such --
Line 15, replace "other" with -- others --
Line 21, delete "the"
Line 41, replace "inito" with -- into --

Column 2,
Line 11, replace "fist" with -- first --
Line 27, replace "has" with -- have --
Line 63, replace "prevent" with -- present --
Line 65, insert -- a -- after "is"
Line 65, insert -- of -- after "view"

Column 3,
Line 1, insert -- a -- after "is"
Line 11, insert -- a -- after "to"
Line 65, replace "fist" with -- first --

Column 4,
Line 23, repalce "has" with -- have --
Line 45, repalce "a" with -- an --

Signed and Sealed this

Twenty-sixth Day of March, 2002

*Attest:*

*Attesting Officer*

JAMES E. ROGAN
*Director of the United States Patent and Trademark Office*